US008069912B2

(12) United States Patent
Campagna et al.

(10) Patent No.: US 8,069,912 B2
(45) Date of Patent: Dec. 6, 2011

(54) HEAT EXCHANGER WITH CONDUIT SURROUNDED BY METAL FOAM

(75) Inventors: Michael J. Campagna, Chillicothe, IL (US); Robert John Moffat, Los Altos, CA (US)

(73) Assignee: Caterpillar Inc., Peoria, IL (US)

( * ) Notice: Subject to any disclaimer, the term of this patent is extended or adjusted under 35 U.S.C. 154(b) by 1064 days.

(21) Appl. No.: 11/905,308

(22) Filed: Sep. 28, 2007

(65) Prior Publication Data

US 2009/0084520 A1 Apr. 2, 2009

(51) Int. Cl.
*F28D 7/16* (2006.01)

(52) U.S. Cl. ..... 165/159; 165/157

(58) Field of Classification Search ..... 165/157, 165/159, 104.19

See application file for complete search history.

(56) References Cited

U.S. PATENT DOCUMENTS

| | | | | |
|---|---|---|---|---|
| 3,595,310 | A * | 7/1971 | Burne et al. | 165/161 |
| 4,252,549 | A | 2/1981 | Chaunce et al. | |
| 4,279,293 | A | 7/1981 | Koump | |
| 4,310,747 | A | 1/1982 | Rice et al. | |
| 4,719,968 | A | 1/1988 | Speros | |
| 5,231,968 | A | 8/1993 | Siefkes | |
| 5,303,768 | A | 4/1994 | Alario et al. | |
| 5,896,896 | A | 4/1999 | Rojey | |
| 5,943,543 | A | 8/1999 | Uchida et al. | |
| 6,033,506 | A | 3/2000 | Klett | |
| 6,037,032 | A | 3/2000 | Klett et al. | |
| 6,142,222 | A * | 11/2000 | Kang et al. | 165/148 |
| 6,196,307 | B1 | 3/2001 | Ozmat | |
| 6,261,485 | B1 | 7/2001 | Klett | |
| 6,287,375 | B1 | 9/2001 | Klett | |
| 6,344,159 | B1 | 2/2002 | Klett | |
| 6,387,343 | B1 | 5/2002 | Klett | |
| 6,398,994 | B1 | 6/2002 | Klett | |
| 6,399,149 | B1 | 6/2002 | Klett et al. | |
| 6,430,935 | B1 | 8/2002 | Klett et al. | |
| 6,581,679 | B2 | 6/2003 | Fischer et al. | |
| 6,656,443 | B2 | 12/2003 | Klett | |
| 6,663,842 | B2 | 12/2003 | Klett | |
| 6,673,328 | B1 | 1/2004 | Klett et al. | |

(Continued)

FOREIGN PATENT DOCUMENTS

EP 1 099 263 B1 4/2002

(Continued)

OTHER PUBLICATIONS

Butcher et al., Compact Heat Exchangers Incorporating Reticulated Metal Foam, Porvair Fuel Technology, http://www.porvairadvancedmaterials.com/documents/Heat%20Exchange.pdf, p. 1.

(Continued)

*Primary Examiner* — Teresa Walberg
(74) *Attorney, Agent, or Firm* — Finnegan, Henderson, Farabow, Garrett & Dunner LLP

(57) ABSTRACT

A heat exchanger is disclosed. The heat exchanger may have a conduit configured to conduct a fluid and at least one body of metal foam surrounding the conduit. The at least one body of metal foam may have a radially inner portion, a radially outer portion, and a radially intermediate portion between the radially inner portion and the radially outer portion. The at least one body of metal foam may have a lower percentage of void space at the radially outer portion as compared to the radially intermediate portion.

17 Claims, 3 Drawing Sheets

U.S. PATENT DOCUMENTS

| | | | | |
|---|---|---|---|---|
| 6,729,269 | B2 | 5/2004 | Ott et al. | |
| 6,763,671 | B1 | 7/2004 | Klett et al. | |
| 6,780,505 | B1 | 8/2004 | Klett et al. | |
| 6,809,304 | B2 | 10/2004 | Besmann et al. | |
| 6,929,866 | B1 | 8/2005 | Williams et al. | |
| 6,971,377 | B2 | 12/2005 | Moyer et al. | |
| 6,976,530 | B2 | 12/2005 | Hayashi et al. | |
| 6,994,154 | B2 | 2/2006 | Nagashima et al. | |
| 7,017,655 | B2 | 3/2006 | Wilson et al. | |
| 7,048,802 | B2 | 5/2006 | Kaeppeler et al. | |
| 7,080,634 | B2 | 7/2006 | Yamashita | |
| 7,086,457 | B2 | 8/2006 | Kienböck et al. | |
| 7,131,288 | B2 | 11/2006 | Toonen et al. | |
| 7,171,956 | B2 | 2/2007 | Igami et al. | |
| 7,174,948 | B2 | 2/2007 | Schindler et al. | |
| 7,225,862 | B2 | 6/2007 | Chin et al. | |
| 2003/0000486 | A1 | 1/2003 | Ott et al. | |
| 2003/0015184 | A1 | 1/2003 | Klipfel et al. | |
| 2003/0168730 | A1 | 9/2003 | Davidson | |
| 2003/0175201 | A1 | 9/2003 | Klett et al. | |
| 2004/0123980 | A1 | 7/2004 | Queheillalt et al. | |
| 2004/0221603 | A1 | 11/2004 | Arik et al. | |
| 2005/0031504 | A1 | 2/2005 | Armstrong et al. | |
| 2005/0230091 | A1 | 10/2005 | Brost et al. | |
| 2006/0278377 | A1 | 12/2006 | Martins et al. | |
| 2009/0056915 | A1* | 3/2009 | Tsai | 165/104.19 |

FOREIGN PATENT DOCUMENTS

| | | | |
|---|---|---|---|
| FR | 2 704 277 | A | 10/1994 |
| FR | 2 856 747 | A | 12/2004 |
| JP | 52134153 | | 11/1977 |
| JP | 60000294 | A | 1/1985 |
| JP | 60232496 | A | 11/1985 |
| WO | WO 98/04814 | A | 2/1998 |
| WO | WO 99/11586 | A | 3/1999 |

OTHER PUBLICATIONS

Haack et al., "Novel Lightweight Metal Foam Heat Exchangers," pp. 1-7.

SAE International, Surface Vehicle Recommended Practice, 2003, pp. 1-11.

RFF, Finned Tube Bundle Exchanger, Catalog 22, Young Touchstone, 2001, pp. 1-4.

http://www.ergaerospace.com/project_gallery.shtml, "Project Gallery," ERG Materials and Aerospace Corporation, Feb. 13, 2006, pp. 1-2.

http://www.smp-training.com/Counterman/TCDaC/HeatingSystems/Pages/heat20.html, Heater Systems & Components, TCD, Dec. 1, 2005, p. 1.

http://www.smp-training.com/Counterman/TCDaC/HeatingSystems/Pages/heat21.html, Heater Systems & Components, TCD, Aluminum Heater Cores, Dec. 1, 2005, p. 1.

Howard and Korinko, http://72.14.203.104/search?g=cache:XQNxkmA5AJQJ:sti.srs.gov/fulltext/ms2002424.pdf+foam+and+braze+or+brazing&hl=en&ie=UTF-8, Vaccum Furance Brazing Open Cell Reticulated Foam to Stainless Steel Tubing, Dec. 1, 2005, pp. 1-10.

U.S. Appl. No. 11/390,636, filed Mar. 28, 2006, "Method of Manufacturing Metallic Foam Based Heat Exchanger," pp. 1-25, Figs. 1-3.

U.S. Appl. No. 11/896,396, filed Aug. 31, 2007, "Heat Exchanger Using Graphite Foam," pp. 1-11, Figs. 1-2.

Rogers et al., "Preparation and Graphization of High-Performance Carbon Foams From Coal," Touchstone Research Laboratory, Ltd.—CFOAM™ Group, pp. 1-5.

Klett, Conway, Thermal Management Solutions Utilizing High Thermal Conductivity Graphite Foams; Oak Ridge National Laboratory; pp. 1-11.

Q. Yu et al., Carbon Foam—New Generation of Enhanced Surface Compact Recuperators for Gas Turbines, Proceedings of GT2005, ASME Turbo Expo 2005, Jun. 6-9, 2005, pp. 1-6.

U.S. Appl. No. 11/319,024, filed Dec. 27, 2005, "Engine System Having Carbon Foam Exhaust Gas Heat Exchanger," pp. 1-20, Figs. 1-5.

* cited by examiner

HEAT EXCHANGER WITH CONDUIT SURROUNDED BY METAL FOAM

TECHNICAL FIELD

The present disclosure relates generally to a heat exchanger and, more particularly, to a heat exchanger with at least one conduit surrounded by metal foam.

BACKGROUND

Machines including, for example, passenger vehicles, generators, and earth moving vehicles utilize a variety of heat exchangers during operation. Heat exchangers may be used to modify or maintain the temperature of fluids circulated throughout machines. For example, an internal combustion engine is generally fluidly connected to several different liquid-to-air and/or air-to-air heat exchangers (e.g., oil cooler, radiator, air cooler) to cool liquids and gases circulated throughout the engine. The circulated fluids may include oil, coolant, exhaust gas, air, or other fluids used in various machine operations.

In general, heat exchangers are devices that transfer thermal energy between two fluids without direct contact between the two fluids. A primary fluid is typically directed through a fluid conduit of the heat exchanger, while a secondary cooling or heating fluid is brought into external contact with the fluid conduit. In this manner, thermal energy may be transferred between the primary and secondary fluids through the walls of the fluid conduit. The ability of the heat exchanger to transfer thermal energy between the primary and secondary fluids depends on, amongst other things, the surface area available for heat transfer and the thermal properties of the heat exchanger materials.

Governments, regulatory agencies, and customers are continually urging machine manufacturers to increase fuel economy, meet lower emission regulations, and provide greater power densities. These demands often lead to increased requirements for thermal energy transfer in the machine's heat exchangers (e.g., a higher power density for a combustion engine may increase the amount of thermal energy created during the operation of the engine, which must subsequently be removed by the radiator and/or oil cooler to ensure proper operation). As a result, machine manufacturers must develop new materials and/or methods for increasing the ability of heat exchangers to transfer heat.

Metal foams have been used in heat exchangers to increase the surface area available for heat transfer. One method of using a metal foam to improve the ability of a heat exchanger to transfer heat is described in U.S. Pat. No. 7,131,288 (the '288 patent), issued to Toonen et al. on Nov. 7, 2006. In particular, the '288 patent discloses a heat exchanger that comprises a number of parallel flow passages that are arranged at a distance from one another and have an elliptical cross section, through which a first fluid, for example a liquid, is guided. A flow body comprises two metal foam parts, each with a gradient of the volume density parallel to the direction of flow of the second fluid (e.g., a gas). In the first metal foam part, the volume density (amount of metal) increases in the direction of flow of the second fluid, while in the second metal foam part the volume density decreases in the direction of flow. Consequently, most metal is present in the immediate vicinity of the flow passages, where the highest heat flux density also prevails. The outer surface of the flow body, in particular the inflow side (and discharge side), is relatively open. The heat exchanger of the '288 patent is preferably of modular structure, so that a plurality of modules can be combined to form a larger unit.

Although the heat exchanger of the '288 patent may use a metal foam to increase heat transfer, it may still be problematic. Specifically, if the heat exchanger is manufactured by forming the metal foam around the passages, the metal foam may at least partially shrink away from the passages during cooling, resulting in poor contact. This foam shrinkage may result in increased resistance to thermal energy transfer between the passage and the metal foam and, thus, reduced performance. Furthermore, due to the low volume density of metal at the outer surface of the metal foam, mechanically and thermally bonding the metal foam to other surfaces (e.g., metal plates, other modules, etc.) may be difficult.

The disclosed heat exchanger is directed to overcoming one or more of the problems set forth above.

SUMMARY OF THE DISCLOSURE

In one aspect, the present disclosure is directed to a heat exchanger. The heat exchanger may include a conduit configured to conduct a fluid and at least one body of metal foam surrounding the conduit. The at least one body of metal foam may include a radially inner portion, a radially outer portion, and a radially intermediate portion between the radially inner portion and the radially outer portion. The at least one body of metal foam may have a lower percentage of void space at the radially outer portion as compared to the radially intermediate portion.

In another aspect, the present disclosure is directed to a method of manufacturing a heat exchanger. The method may include creating a hole in a body of metal foam and inserting a conduit into the hole. The method may further include compressively deforming the body of metal foam into contact with the conduit.

DETAILED DESCRIPTION

Figure 1:
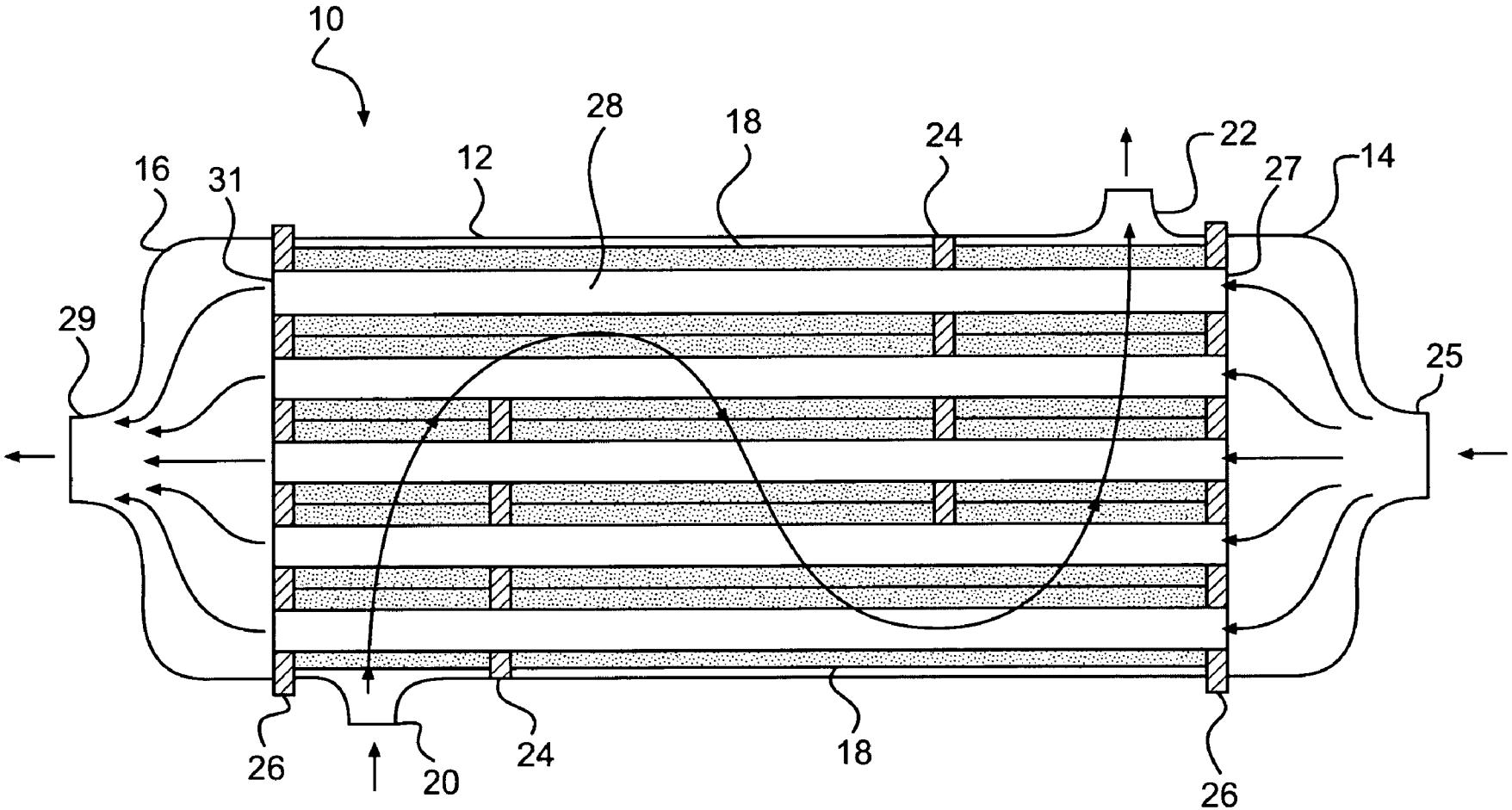
FIG. 1 is a cross-sectional illustration of an exemplary disclosed heat exchanger.

FIG. 1 illustrates a heat exchanger 10. Heat exchanger 10 may be a shell and tube heat exchanger, a heat pipe heat exchanger, or any other tube-type heat exchanger that facilitates transfer of thermal energy between two or more fluids. The fluids may include liquids, gasses, or any combination of liquids and gasses. For example, the fluids may include air, exhaust, oil, coolant, water, or any other fluid known in the art. Heat exchanger 10 may be used to transfer thermal energy in any type of fluid system, such as, for example, an exhaust and/or air cooling system, a radiator system, an oil cooling system, a condenser system, or any other type of fluid system known in the art. Heat exchanger 10 may include a housing 12, a first manifold 14, a second manifold 16, and at least one conduit assembly 18.

Housing 12 may be a hollow member configured to conduct fluid across conduit assemblies 18. Specifically, housing 12 may have an inlet 20 configured to receive a first fluid and an outlet 22 configured to discharge the first fluid. Housing 12 may also have one or more baffles 24 located to redirect the first fluid. The redirection of the first fluid may help increase the transfer of heat by increasing the first fluid's interaction with conduit assemblies 18 (i.e., preventing a direct flow path from inlet 20 to outlet 22) and/or directing the first fluid to flow in a direction approximately normal to a flow direction of a second fluid within conduit assemblies 18 (i.e., creating a cross flow configuration). It is contemplated that baffles 24 may also be rearranged to create a parallel flow or counter flow configuration.

Housing 12 may further include one or more support members 26. Support members 26 may embody plate-like members that include a plurality of holes configured to receive and support conduit assemblies 18. Support members 26 may couple to conduit assemblies 18 via mechanical fastening, chemical bonding, welding, or in any other appropriate manner. It is contemplated that support members 26 may be manufactured of a rubber-based material that supports and seals to each end of conduit assemblies 18. Rubber support members may couple to conduit assemblies 18 via an interference or press fit to allow for easy replacement of conduit assemblies 18. Support members 26 may alternatively be manufactured of metal, plastic, composite, or any other material known in the art.

First and second manifolds 14 and 16 may be hollow members that distribute the second fluid to or gather the second fluid from a conduit 28 of each conduit assembly 18. First manifold 14 may have a first orifice 25, and a plurality of second orifices 27 fluidly connected to input ends of a plurality of conduits 28. Second manifold 16 may have a plurality of second orifices 31 fluidly connected to output ends of conduits 28 and a first orifice 29. It is contemplated that first orifice 25 of first manifold 14 and/or first orifice 29 of second manifold 16 may be fluidly connected to a fluid system component (not shown), such as, for example, a filter, a pump, a nozzle, a power source, or any other fluid system component known in the art. It is contemplated that the second fluid may flow through first manifold 14 and second manifold 16 in either direction (i.e., the second fluid may enter first manifold 14 and exit second manifold 16 or enter second manifold 16 and exit first manifold 14).

Figure 2:
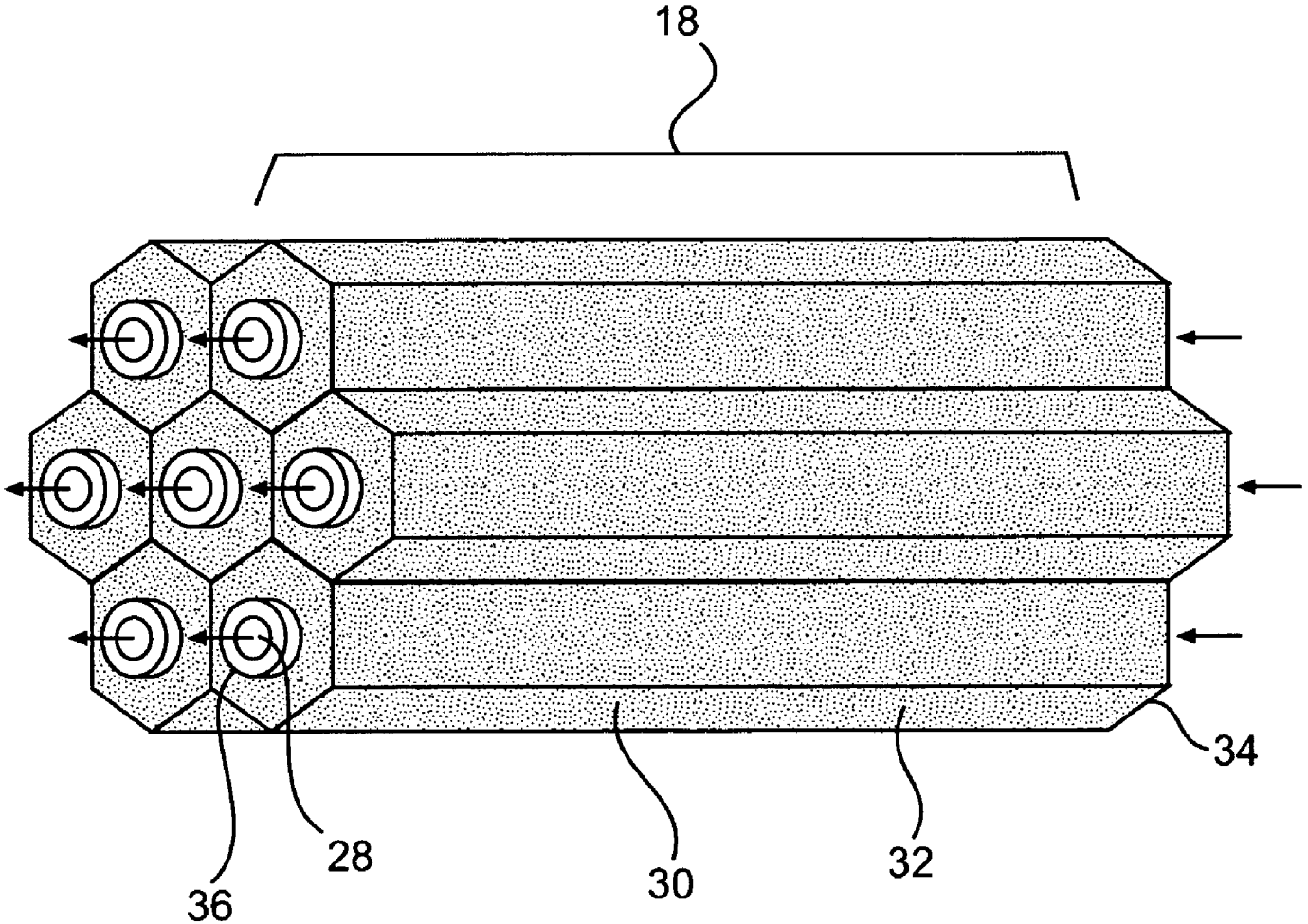
FIG. 2 is a pictorial illustration of a plurality of conduit assemblies for use in the heat exchanger of FIG. 1.

Referring to FIG. 2, each conduit assembly 18 may include one conduit 28 and a foam body 30 surrounding conduit 28. A plurality of conduit assemblies 18 may be bundled together such that the foam bodies of adjacent conduit assemblies 18 are substantially in contact or bonded one to another.

Conduits 28 may be elongated members that conduct the second fluid through each conduit assembly 18 and promote the transfer of thermal energy between the first and second fluids. Conduits 28 may include an inlet 34 and an outlet 36 and may be manufactured of any metal, such as, for example, copper, aluminum, steel, or any other metal known in the art. Conduits 28 may have any cross-sectional shape, such as, for example, a circular shape, an elliptical shape, or a rectangular shape. It is contemplated that conduits 28 may include turbulence promoting or enhancing structures (e.g., turbulators) located on an interior surface of conduits 28. These turbulence promoting structures may comprise ridges, fins, angled strips, pins, or other types of protrusions or distortions.

Foam body 30 may comprise a body of a foam 32 through which conduits 28 may traverse. Foam 32 of foam body 30 may embody a network of connected ligaments composed of a metal, such as, for example, copper, aluminum, silver, gold, nickel, or any other appropriate metal known in the art. Foam 32 may be formed with an open cell structure or a combination of an open cell and closed cell structure. The percentage of void space in foam 32 (i.e., the percentage of space not occupied by metal material) may be modified to create a pressure drop, a flow rate, and/or a heat transfer surface area for a particular application of heat exchanger 10. Foam 32 may be formed with a uniform percentage of void space (void space being dependent on the number and size of metal ligaments per unit volume) or alternatively with a gradient of void space (e.g., radial gradient, axial gradient, etc.). For example, foam 32 may be formed with a lower percentage of void space at a radially inner (i.e., near conduit 28) and/or a radially outer portion of foam body 30 as compared to a percentage of void space at a radially intermediate portion (i.e., between the inner and outer portions) of foam body 30. It is contemplated that a radial length of each of the radially inner and radially outer portions may be at least 1 mm.

Foam body 30 may be compressed or crushed into contact with conduit 28. The compression and/or deformation of foam 32 may ensure good contact for bonding and decrease the percentage of the void space (i.e., increase metal material available for bonding) at the inner and/or outer portions. The compression process may also be used to give foam body 30 any cross-sectional shape, such as, for example, a circular, a hexagonal, a pentagonal, a rectangular, or any other cross-sectional shape known in the art. The cross-sectional shape may be selected to allow for efficient bundling of conduit assemblies 18. For example, certain polygonal shapes (e.g., rectangular, hexagonal, pentagonal, or combinations thereof) may allow for bundling of conduit assemblies 18 with reduced interstitial space between adjacent conduit assemblies 18. It is contemplated that foam 32 of foam body 30 may be bonded to an outer surface of conduit 28 using a brazing process and a brazing material. The brazing material may be composed of, for example, silver, copper, tin, magnesium, aluminum-silicon, and/or other materials known in the art. It is further contemplated that the brazing material may be used to attach an outer surface of foam body 30 to another foam body 30, a plate, a bar, or any other appropriate surface.

INDUSTRIAL APPLICABILITY

The disclosed heat exchanger may be implemented in any cooling or heating application where improved heat transfer capabilities are desired. The disclosed heat exchanger may improve heat transfer capabilities by increasing a density, a surface area, or a surface contact of foam at a location that may be bonded to a conduit and/or another body of foam. The operation of heat exchanger 10 will now be explained.

Referring to FIG. 1, heat exchanger 10 may be utilized, for example, to transfer thermal energy between a lower temperature first fluid flowing through housing 12 and a higher temperature second fluid flowing through conduits 28. The lower temperature first fluid may be received into housing 12 via inlet 20. The first fluid may then be directed by baffles 24 to flow in a switchback-like pattern past conduit assemblies 18. While flowing past conduit assemblies 18, the first fluid may flow between the ligaments and through the void spaces of foam 32. The switchback-like pattern may increase the percentage of the total flow path where the first fluid is flowing in a direction generally normal to the flow direction of the second fluid.

While the first fluid flows through housing 12, first manifold 14 may receive the higher temperature second fluid and may distribute the second fluid into the inlet ends of conduits 28. After entering conduits 28, the second fluid may be conducted through the length of each of conduits 28. As the second fluid flows through each of conduits 28, the thermal energy from the higher temperature second fluid may be conducted through conduits 28 and the ligaments of foam 32 into the lower temperature first fluid. As the thermal energy is transferred from the second fluid to the first fluid, the temperature of the second fluid may decrease.

Figure 3:
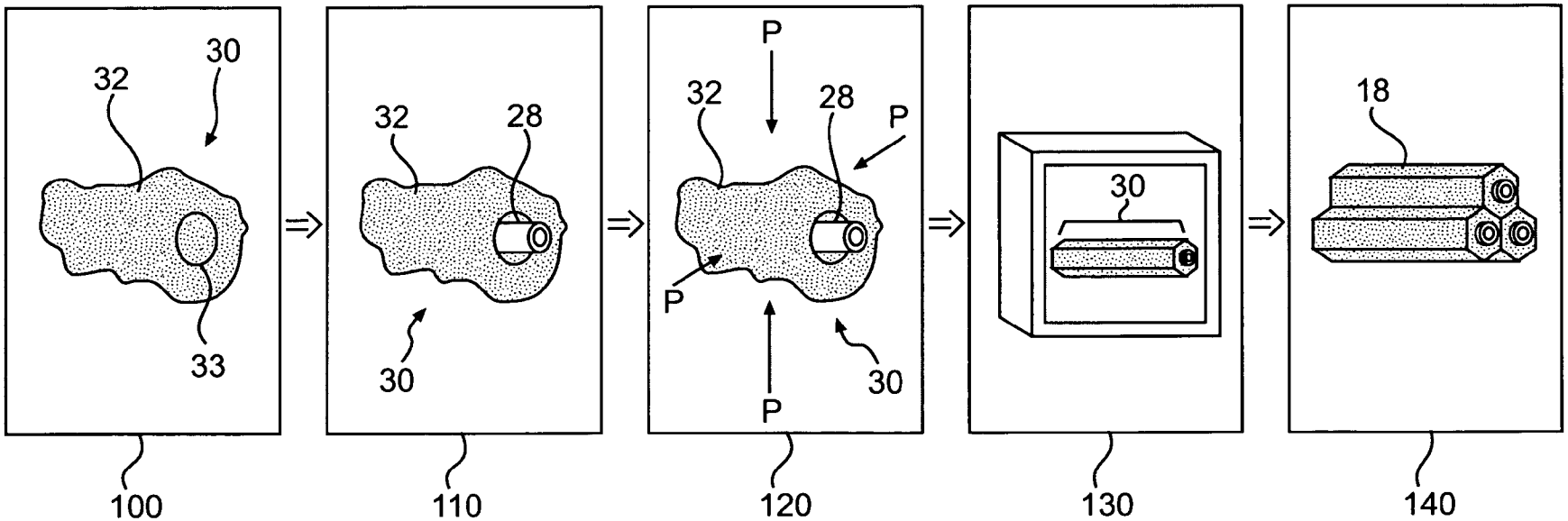
FIG. 3 is an illustration of a method for manufacturing the conduit assemblies of FIG. 2.

FIG. 3 outlines an exemplary manufacturing process for each conduit assembly 18. The manufacturing of conduit assembly 18 may commence by forming foam body 30 and creating a hole 33 in foam body 30 (step 100). Foam 32 may be formed with a radial gradient of void space such that a lower percentage of void space exists (on average) at the inner and/or outer portion of foam body 30 as compared to the percentage of void space (on average) at the radially intermediate portion of foam body 30. Foam 32 may alternatively be formed with a uniform percentage of void space and the outer portion of foam body 30 may undergo a surface-peening or other deformation process to modify its percentage of void space. Hole 33 may be created in foam body 30 during the formation process of foam 32 or, alternatively, hole 33 may be drilled, milled, or created using any other material removal process. Conduit 28 may then be inserted into hole 33 (step 110). Prior to insertion, conduit 28 may be clad or covered in a brazing material (e.g., silver, copper, gold, or other appropriate metals).

A compressive force P may be applied to the outer surface of foam body 30 (step 120), thus crushing or compressing foam 32 of foam body 30 into contact with conduit 28 and creating a resulting foam and conduit unit. Compressive force P may be produced by, for example, a mechanical press, a pneumatic press, a hydraulic press or other appropriate machine or device. The compression step may increase the mechanical and thermal contact between conduit 28 and foam 32 and may decrease the percentage of the void space at the inner and/or outer portion of foam body 30.

The change in the percentage of the void space created by the compression step may be in addition or as an alternative to forming foam 32 with the gradient of void space and/or the surface-peening process. For example, when a desired void space profile is created in foam body 30 during formation of foam 32, only a small compressive force P may be applied to create contact between conduit 28 and foam 32. Alternatively, a larger compressive force P may be used to modify the void space profile of foam body 30. It is contemplated that after the compression step foam body 30 may have a lower percentage of void space at the radially outer portion and the radially inner portion of a cross-section as compared to the radially intermediate portion. For example, the percentage of void space at the radially intermediate portion may range from approximately 60 to 90%, and the percentage of void space at the radially inner and outer portions may be approximately 2 to 4 times less than the percentage of void space at the radially intermediate portion. It is also contemplated that the percentage of voice space of the radially outer portion and the radially inner portion may be substantially the same. The compression step may give foam body 30 a shape, such as, for example, a circular, a hexagonal, a pentagonal, a rectangular, or any other shape known in the art.

The resulting foam and conduit unit may then be brazed (step 130) to complete conduit assembly 18. The resulting foam and conduit unit may be brazed using, for example, furnace brazing, vacuum brazing, induction brazing, or any other appropriate brazing method. Prior to brazing, a brazing flux material may be applied to the resulting foam and conduit unit. It is contemplated that the compression force P may be maintained through brazing process, if desired.

A plurality of (brazed) conduit assemblies 18 may be bundled or joined together (step 140) for use in heat exchanger 10. Conduit assemblies 18 may be joined using mechanical joining, chemical bonding, brazing, welding, or any other joining process known in the art. The lower percentage of void space at the outer portion of conduit assemblies 18 may create more metal surface area, thus improving bonding of conduit assemblies 18 to one another and/or to other surfaces.

The disclosed heat exchanger may improve heat transfer capabilities by increasing a percentage of material, a surface area, and/or a surface contact of foam at a location that may be bonded to a conduit and/or another body of foam. The disclosed compression or deformation process may achieve multiple of the aforementioned results simultaneously, thus reducing the number of manufacturing steps and manufacturing costs. Furthermore, using independently manufactured conduit assemblies may allow for the mechanical and thermal joining of several conduit assemblies in any configuration to improve the capacity of the disclosed heat exchanger.

It will be apparent to those skilled in the art that various modifications and variations can be made to the disclosed heat exchanger. Other embodiments will be apparent to those skilled in the art from consideration of the specification and practice of the disclosed heat exchanger. For example, the foam body of the disclosed heat exchanger may alternatively be formed around the conduits and subsequently compressed to ensure good contact. It is intended that the specification and examples be considered as exemplary only, with a true scope being indicated by the following claims and their equivalents.

What is claimed is:

1. A heat exchanger, comprising:

a conduit, the conduit being configured to conduct a fluid; and at least one body of metal foam surrounding the conduit, the at least one body of metal foam having a radially inner portion surrounding the conduit, a radially outer portion surrounding the conduit, and a radially intermediate portion surrounding the conduit between the radially inner portion and the radially outer portion, the radially outer portion having a lower percentage of void space as compared to the radially intermediate portion.

2. The heat exchanger of claim 1, wherein the at least one body of metal foam has a polygonal cross-section.

3. The heat exchanger of claim 1, wherein the radially outer portion of the at least one body of metal foam is coupled to the radially outer portion of another at least one body of metal foam.

4. The heat exchanger of claim 1, further including:

a housing surrounding the at least one body of metal foam;

a support member configured to support the at least one body of metal foam and the conduit;

a first manifold fluidly coupled to an inlet of the conduit; and a second manifold fluidly coupled to an outlet of the conduit.

5. The heat exchanger of claim 4, wherein the support member is composed of a rubber-type material.

6. The heat exchanger of claim 4, further including one or more baffles located within the housing.

7. The heat exchanger of claim 1, wherein the at least one body of metal foam is compressively deformed into contact with the conduit.

8. The heat exchanger of claim 1, wherein the at least one body of metal foam is manufactured of at least one of copper, aluminum, silver, gold, or nickel and the conduit is clad in at least one of silver, copper, tin, magnesium, or aluminum-silicon.

9. A heat exchanger, comprising:

a conduit, the conduit being configured to conduct a fluid;

at least one body of metal foam surrounding the conduit, the at least one body of metal foam having a radially inner portion, a radially outer portion, and a radially intermediate portion between the radially inner portion and the radially outer portion, the body of metal foam having a lower percentage of void space at the radially outer portion and the radially inner portion as compared to the radially intermediate portion, the percentage of void space at the radially inner portion and the radially outer portion being substantially the same;

a housing surrounding the body of metal foam;

a support member configured to support the body of metal foam and the conduit;

a first manifold fluidly coupled to an inlet of the conduit; and a second manifold fluidly coupled to an outlet of the conduit.

10. The heat exchanger of claim 9, wherein a compression process is used to create the lower percentage of void space at the radially inner portion of the body of metal foam.

11. The heat exchanger of claim 10, wherein at least surface-peening is used to create the lower percentage of void space at the radially outer portion of the body of metal foam.

12. The heat exchanger of claim 9, further including one or more baffles located within the housing.

13. The heat exchanger of claim 9, further including a brazing material configured to couple the body of metal foam to the conduit.

14. A heat exchanger, comprising:

a first independent unit including:

a first conduit configured to conduct a fluid;

a first body of metal foam surrounding the first conduit, the first body of metal foam having a first annular portion and a second annular portion exterior to the first annular portion, the first body of metal foam having a lower percentage of void space at the first annular portion of the first body of metal foam as compared to the second annular portion of the first body of metal foam; and a second independent unit including:

a second conduit configured to conduct a fluid;

a second body of metal foam surrounding the second conduit, the second body of metal foam having a first annular portion and a second annular portion exterior the first annular portion, the second body of metal foam having a lower percentage of void space at the first annular portion of the second body of metal foam as compared to the second annular portion of the second body of metal foam, wherein the first unit is configured to abut and attach to the second unit.

15. The heat exchanger of claim 14, wherein the first body of metal foam and the second body of metal foam each have a polygonal cross-section.

16. The heat exchanger of claim 14, wherein the first unit is attached the second unit via brazing.

17. The heat exchanger of claim 14, wherein the first unit and the second unit are located within a housing.

* * * * *